United States Patent [19]

Sumitomo

[11] 4,228,850

[45] Oct. 21, 1980

[54] PLATE USED IN CONDENSER

[75] Inventor: Hiroyuki Sumitomo, Osaka, Japan

[73] Assignee: Hisaka Works, Ltd., Osaka, Japan

[21] Appl. No.: 927,689

[22] Filed: Jul. 25, 1978

[30] Foreign Application Priority Data

Nov. 8, 1977 [JP] Japan ..... 52-134254

[51] Int. Cl.[2] ..... F28B 9/08; F28D 9/00; F28F 3/08

[52] U.S. Cl. ..... 165/110; 165/166; 165/170

[58] Field of Search ..... 165/110, 111, 166, 167, 165/170

[56] References Cited

U.S. PATENT DOCUMENTS

| | | | |
|---|---|---|---|
| 2,285,225 | 6/1942 | Norris | 165/166 |
| 3,532,161 | 10/1970 | Lockel | 165/167 |

*Primary Examiner*—Sheldon Richter

*Attorney, Agent, or Firm*—Armstrong, Nikaido, Marmelstein & Kubovcik

[57] ABSTRACT

A plate used in a plate type condenser comprises inclined grooves having a V-shaped external appearance and a vertical groove which extends through the bottoms of the V's to communicate with the inclined grooves, so that the condensate flows down along the inclined grooves and then along the vertical groove to be discharged out of the condenser.

1 Claim, 4 Drawing Figures

PLATE USED IN CONDENSER

BACKGROUND OF THE INVENTION (a) Field of the Invention

The present invention relates to improvements in the plates used in a condenser.

(b) Description of the Prior Art

Generally, it is film coefficient that becomes a problem in improving the ability of the plate type condenser to transfer heat for condensation. Film coefficient is an index of easiness of heat transfer on the heat transfer surface and is defined as (the thermal conductivity of the film)/(the film thickness) and it varies with the condition in which the condensate adheres to the heat transfer surface. If vapor is fed to a vapor chamber, condensate like a thin film will form on all the heat transfer surface. As the condensation continues, the film becomes progressively thicker until it flows down along the heat transfer surface under its own weight while forming a thick filmy downflow liquid layer on the heat transfer surface in the middle lower area over the substantially entire width thereof, said downflow liquid layer being progressively thicker, as the bottom is approached. The heat transfer surface thus covered with the downflow liquid is prevented from contacting the vapor and the thick film of liquid greately decreases the film coefficient and hence lowers the heat transfer performance. Therefore, in order to improve the heat transfer performance of the entire heat transfer surface on which vapor condenses, some means will be required which minimize the area of the filmy downflow liquid layer and which prevents said film from growing too thick.

The applicant has previously proposed a condenser (Japanese Patent Application No. 152364/75) which comprises a condensate collecting and discharging mechanism (water collecting means) provided in each fixed region of a condensing and heat transfer surface, and longitudinal grooves disposed between such water collecting means and extending in the direction of flow of condensate. An outline of this arrangement is as follows.

As shown in FIGS. 1 and 2, a plate 1 is provided with water collecting means each comprising a hill-like inclined groove 2 and vertical grooves 3 and opening to a vapor passage side A, and a group of longitudinal grooves 4 extending in the direction of flow of condensate are formed between adjacent water collecting means 2, 3 to open at their lower ends to said inclined groove 2. The function and effect of the water collecting means are such that the condensate which forms on the heat transfer surface is drawn to the valleys 4*a* of the longitudinal grooves 4 by the action of surface tension to form downflow liquid layers only in the valleys 4*a*, and the condensate thus collected in the valleys 4*a* flows down under its own weight and is collected and discharged by the water collecting means 2, 3. As a result, the downflow liquid layers are considerably reduced when considered from the entire heat transfer surface, so that the heat transfer performance is improved.

However, since the direction in which the vapor is fed extends from the top and opposite lateral sides of the plate 1 and since, on the other hand, the inclined grooves 2 of the water collecting means 2, 3 provided on the plate 1 are inclined like a hill, as described above, there are many places where the direction of flow of the condensate is opposed to the direction of flow of the vapor when the condensate is moved downward while moving slantwise along the inclined grooves 2. At said places, the condensate will flow counter to the flow of the vapor. Therefore, the condensate is pushed back by the vapor stagnate in the inclined grooves 2 and meet the succeeding condensate, with the inclined grooves 2 becoming locally clogged, so that the condensate floods the inclined grooves 2 to flow down to the lower heat transfer surface region. As a result, the film on the heat transfer surface becomes thick again and grows broader, decreasing the film coefficient and lowering the heat transfer performance.

SUMMARY OF THE INVENTION

The present invention is intended to provide an improved plate used in a condenser to eliminate the disadvantages described above.

DESCRIPTION OF THE PREFERRED EMBODIMENT

Figure 2:
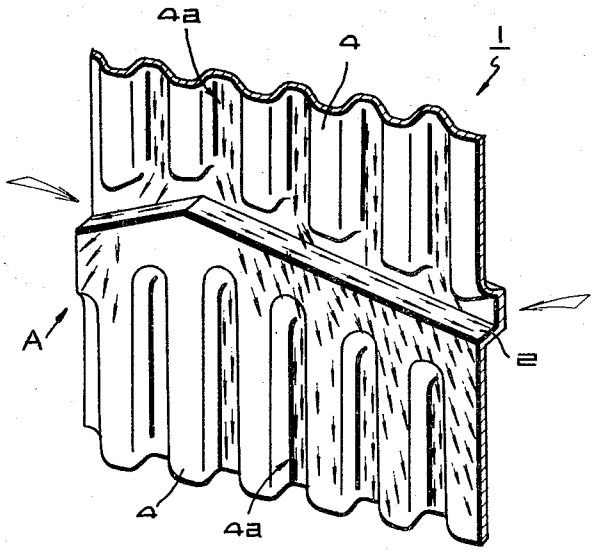
FIG. 2 PRIOR ART
FIG. 2 is a perspective view of the plate shown in FIG. 1.
Figure 1:
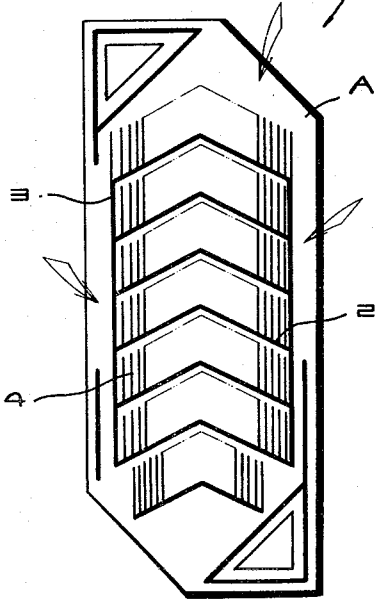
FIG. 1 PRIOR ART
FIG. 1 is a schematic front view of a conventional example of a plate used in a condenser.
Figure 4:
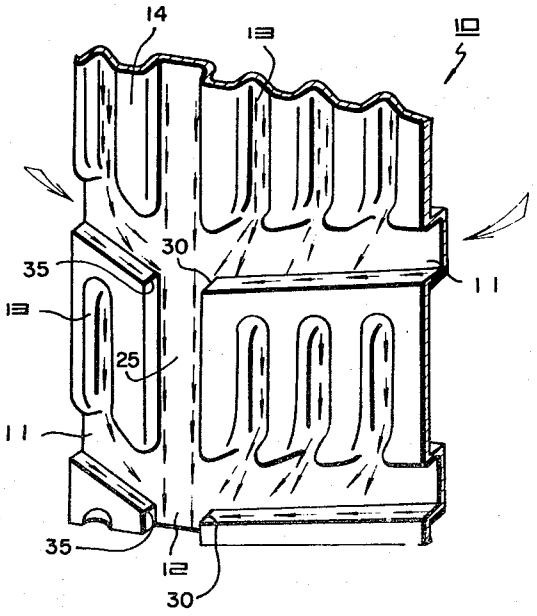
FIG. 4 is a perspective view of the embodiment shown in FIG. 3.
Figure 3:
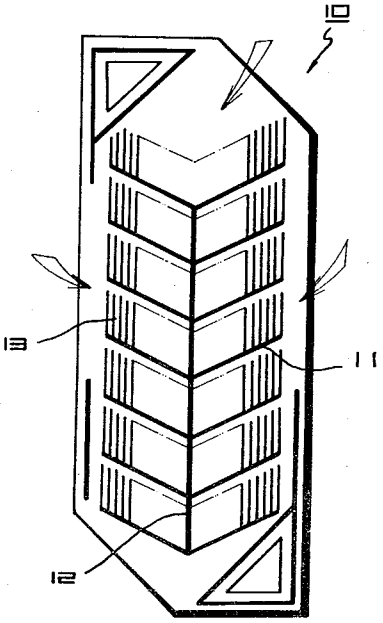
FIG. 3 is a schematic front view of an embodiment of the present invention.

As shown in FIGS. 3 and 4, an inclined groove 11 provided in each fixed region of the condensating and heat transfer surface 25 of a plate 10 is formed to have a V-shaped appearance and a vertical groove 12 extending through these inclined grooves 11 at their centers. Each inclined groove 11 has a pair of edges comprising a first edge 30, and a second edge 35 at the intersection of inclined groove 11 and vertical groove 12, edges 30 and 35 of each pair of edges are in a single plane perpendicular to the plane of surface 25 of plate 10, thereby eliminating the disadvantages described above. As a result of the V shape of the inclined grooves 11, the direction of flow of the condensate which flows down along the valleys 13 between vertical ridges 14 and then along the inclined grooves 11 to the vertical groove 12 to be discharged out of the condenser substantially coincides with the direction of flow of vapor which is fed from the top and opposite lateral sides of the plate 10, so that the condensate can be discharged out of the condenser as it passes along the inclined grooves 11 and the vertical groove 12 without being impeded by the flow of the vapor. Further, such substantial coincidence of the direction of flow of the condensate with the direction of flow the vapor results in the condensate being forced out of the condenser by the flow of the vapor, allowing the succeeding condensate to be smoothly discharged out of the condenser, so that the heat transfer performance can be greatly improved as compared with the conventional plate.

While a specific embodiment of the invention has been described in detail with reference to the accompanying drawings, it is to be understood that the invention is not limited thereto and that various changes and modifications may be made by those skilled in the art without departing from spirit and scope of the invention.

What is claimed is:

1. A plate for use in a condenser, said plate including condensate collecting and discharging elements, said condensate collecting and discharging elements comprising a plurality of V-shaped inclined grooves downwardly sloped towards a central portion of said plate, and a vertical groove formed along said central portion of said plate connecting with a lowest portion of each of said inclined grooves, wherein said inclined grooves form ramps leading to said vertical groove and said vertical groove forms a recessed channel, said condensate collecting and discharging elements further comprising a plurality of alternating longitudinal grooves and valleys, lower ends of said valleys opening towards said downwardly sloped inclined grooves, whereby said inclined grooves and said vertical groove minimizes the area of a filmy downflow liquid layer and prevents a film from growing too thick, thereby improving the heat transfer surface of said plate.

* * * * *